United States Patent [19]

Bolton et al.

[11] Patent Number: 4,777,870

[45] Date of Patent: Oct. 18, 1988

[54] ADJUSTABLE AIR SWEEP MECHANISM FOR A ROOM AIR CONDITIONER

[75] Inventors: Theodore S. Bolton, Liverpool; Richard D. Lang, Chittenango, both of N.Y.

[73] Assignee: Carrier Corporation, Syracuse, N.Y.

[21] Appl. No.: 115,301

[22] Filed: Nov. 2, 1987

[51] Int. Cl.[4] ..... F24F 3/16

[52] U.S. Cl. ..... 98/40.24; 98/40.3; 98/94.2; 98/121.2; 74/43

[58] Field of Search ..... 62/262; 98/40.24, 40.28, 98/40.3, 94.2, 107, 113, 121.2; 74/42, 431, 51

[56] References Cited

U.S. PATENT DOCUMENTS

| | | | |
|---|---|---|---|
| 3,330,202 | 7/1967 | Del Colle | 98/40.3 |
| 4,018,159 | 4/1977 | Bennett | 62/262 X |
| 4,534,279 | 8/1985 | Cardiff | 98/40.3 |
| 4,628,801 | 12/1986 | Hashimoto | 98/40.3 |
| 4,632,021 | 12/1986 | Bolton et al. | 98/40.3 |
| 4,653,386 | 3/1987 | Hayakawa et al. | 98/40.24 X |
| 4,676,146 | 6/1987 | Takahashi et al. | 98/40.3 |

*Primary Examiner*—William E. Tapolcai
*Attorney, Agent, or Firm*—Dana F. Bigelow

[57] ABSTRACT

The discharge air sweep mechanism for an air conditioner is provided with slippage in its drive linkage such that the position of the vanes can be manually adjusted when the drive motor is turned off, or if the vanes become jammed during normal air sweep operation, the drive motor can continue to operate without damage to the mechanism. In one form of linkage, frictional engagement is provided by a pair of arms that are biased together with engaged member disposed therebetween, with the engaged member being allowed to slide between the arms upon the occurrences of either of the above mentioned conditions. Vane stop means is provided to automatically recalibrate the relative positions when normal air sweep operation is resumed.

11 Claims, 2 Drawing Sheets

ADJUSTABLE AIR SWEEP MECHANISM FOR A ROOM AIR CONDITIONER

BACKGROUND OF THE IVENTION

This invention relates generally to air conditioning systems and, more particularly, to apparatus for manually adjusting the position of an air sweep mechanism on a room air conditioner.

In the localized approach to air conditioning, as is applied with the so called "room air conditioner", it is common to provide a plurality of louvers in the air discharge opening such that the direction of air flow can be controlled as desired. It has also become common practice to provide an "air sweep" mechanism in these devices which causes the louvers to be continuously oscillated back and forth to "sweep" the air flow stream between the extreme points on either side. However, with such an air sweep mechanism, it is sometimes desirable to inactivate the air sweep feature so that all of the cold air is discharged in a desired fixed direction. In order to accomplish this with a conventional system, it is necessary for the operator to wait until the sweep mechanism rotates the louvers to the desired position, and then turn the air sweep mechanism off. Besides the disadvantage of having to wait until the louvers arrive at the desired position, such a method also requires one to anticipate the amount of coasting that will occur after the sweep mechanism is turned off but before the louvers come to a complete stop.

One approach to the above problem has been that shown in U.S. Pat. No. 4,632,021, assigned to the assignee of the present invention, wherein provision is made for an operator to move a selector lever to the desired louver position. When the louvers do arrive at a position aligned with the selector lever, the sweeping movement is automatically stopped and the louvers remain in that fixed position. However, it should be recognized that this arrangement was implemented by way of an air driven sweep mechanism which was "turned off" by way of a simple mechanical interference arrangement. If an electric drive motor is used to drive the sweep mechanism, such an implementation would not be practical.

Another problem that may occur with an air sweep mechanism is that of an accidental or unplanned interference which would cause a "jamming" of the louvers. This might occur, for example, if a foreign object is accidentally inserted into the discharge area, or a child takes hold of one of the louvers. As a result, damage may occur to the sweep mechanism or the the drive motor, or both.

It is therefore an object of the present invention to provide an improved air sweep mechanism for a room air conditioner.

Another object of the present invention is the provision for easily adjusting the louvers of an air sweep mechanism to a desired fixed position. Yet another object of the present invention is the provision for protecting an air sweep mechanism from damage which may occur by accidental jamming.

Still another object of the present invention is the provision for an air sweep mechanism which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, a multiple link mechanism is provided to mechanically connect the drive motor to the louver portion of the air sweep mechanism. Provision is made in those multiple link members such that selective slippage will occur when preselected levels of pressure are brought the bear thereon. In this way, relative movement between the drive motor and the louvers can occur either when an operator wishes to override the linkage as it has been positioned by the drive motor, or to allow the drive motor to continue to operate even though the louvers themselves are unable to move.

In one embodiment of the invention, a pair of substantially parallel arms are connected at their one end to a motor driven linkage which operates to oscillate the arms. The arms are biased together at their other ends so as to frictionally hold a linkage member between the two arms. When either of the above two conditions occur, the frictionally held member is allowed to slide within the elongate space between the two arms to bring about the desired result.

In accordance with another aspect of the invention, provision is made for resetting the positional relationships between the louvers and the drive motor after that relationship has been modified as a result of slippage occurring within the linkage mechanism. That is, when normal air sweep operation is resumed, the slippage that has occurred within the linkage is removed by allowing the desired relative positions of the drive motor and the louvers to be re-established.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
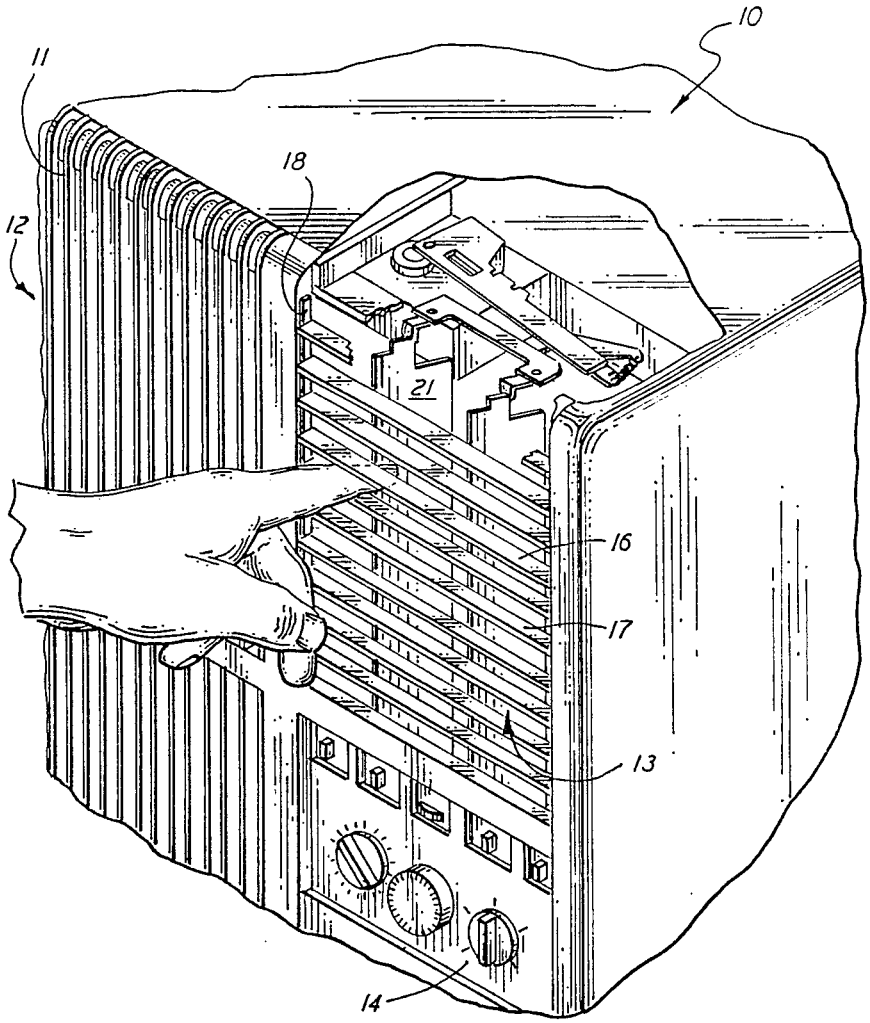
FIG. 1 is perspective view of a room air conditioner with a portion of the cover broken away to show the present invention.

Referring now to FIG. 1, the present invention is shown generally at 10 as incorporated into a room air conditioner of the side discharge type. A front grill structure 11 is provided at the front face of the unit and includes openings that correspond with the return air opening 12, the air discharge opening 13, and the control panel 14 of the unit. In operation, a blower within the system draws the warm room air into the return air opening 12, where it then passes through the evaporator coil to be cooled. The blower then causes the cooler air to flow to the discharge air opening 13 where it is again injected into the room.

It will be seen that within the discharge air opening 13 there is disposed an air diversion structure 16 for diverting the flow of discharge air in a selected direction above or below the horizontal plane. The air diversion structure 16 comprises a plurality of horizontally disposed louvers 17 pivotally mounted at their ends in side support members 18. A gang bar interconnects the louvers 17 such that when an operator adjusts the rotational position of one louver, all of the louvers 17 are caused to move to corresponding positions. Such an adjustment is manually made by the operator and can be made either by moving a single louver as described hereinabove or by moving the gang bar directly.

Also shown in the discharge opening 13, located just behind the air diversion structure 16, is a pair of vertically disposed vanes 21 which operate to direct the flow of discharge air in selected angular directions along a horizontal plane as they are pivoted on their vertical axes. In accordance with the present invention, these vanes can be made to remain in fixed positions or they can be made to constantly pivot, first in one direction and then the other, to thereby sweep the air back and forth between two extreme angular positions. The air sweep mechanism is shown in the broken away portion of FIG. 1 and in FIG. 2.

Figure 2:
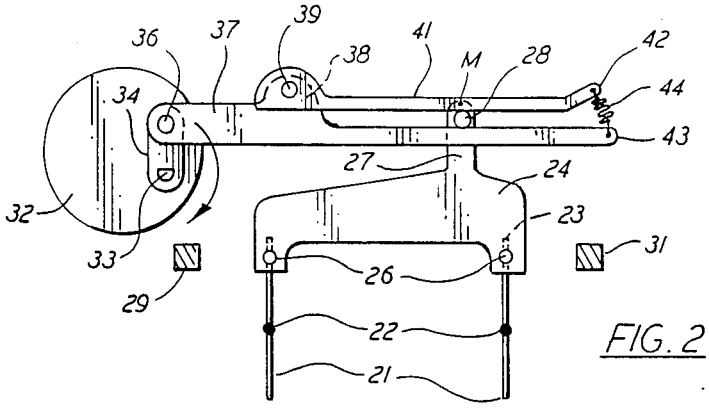
FIG. 2 is a schematic illustration of the sweep mechanism portion of the present invention.

Referring to FIG. 2, the vanes 21 are rotatably mounted within the discharge air opening 13 by way of vertically disposed pivot rods 22. Toward the vanes' inner ends 23 they are interconnected by way of a gang bar 24 and pivot pins 26. The gang bar 24 has a rearwardly extending arm 27, which in turn has an upwardly extending pin 28 at its end. In operation, it will be seen that as the pin 28 is moved from side to side by the drive mechanism to be described, the gang bar 24, as well as the vane ends 23, will be moved from side to side, thereby causing the vanes to pivot about their pivot rods 22 and sweep the discharge air from side to side.

It will be seen that a pair of stops 29 and 31 are provided on either side of the vanes 21. These stationary stops operate with the vanes 21 for the purpose and manner to be described hereinafter.

Motive power to the sweep mechanism is provided by way of a motor 32 with a drive shaft 33. As will be seen in FIG. 2, the drive shaft 33 has a D-shaped cross section and fits into a D-shaped hole in the cam member 34. Rotatably connected to the other end of the cam member 34 by the pin 36 is the reciprocating link 37, which is an elongate member having a boss 38 near its midpoint. Pivotally connected to the boss 38 by the pin 39 is a pressure bar 41 whose free end 42 cooperates with the free end 43 of the reciprocating link 37 to capture the gang bar pin 28 therebetween. A tension spring 44 is connected between the two free ends 42 and 43 to bias those ends together such that when the motor 32 causes the reciprocating link 37 to reciprocate, the pin 28 and its associated gang bar 24 will also reciprocate.

However, if one of the above mentioned conditions, i.e., jammed vanes or the need to manually set the vanes to a fixed position should exist, then the pin 28 will be allowed to slip along the elongate space between the reciprocating link 37 and the pressure bar 41. That is, if the vanes become jammed while the sweep mechanism is in operation, the motor will continue to drive the reciprocating link 37, and that link will continue to reciprocate while the pin 28 remains stationary.

If, on the other hand, one wishes to manually set the vanes to a fixed position, the motor 32 is turned off such that the reciprocating link 37 remains stationary. Manual movement of the vanes 21 will then cause movement of the gang bar 24, and the pin 28 will then slide within the elongate space between the reciprocating link 37 and pressure bar 41.

Figure 3:
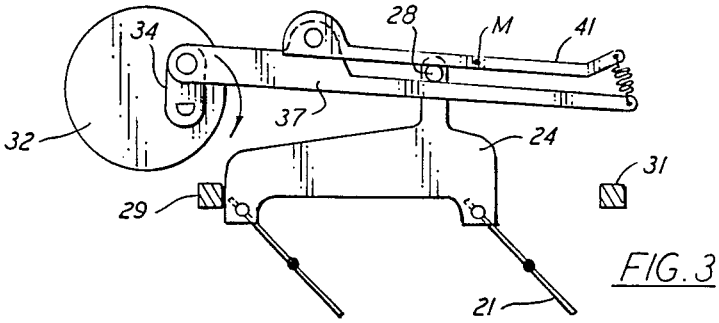
FIG. 3 is a schematic illustration thereof after manual adjustment of the louvers.

When the sweep mechanism is in the position shown in FIG. 2, the gang bar pin 28 is aligned with a midpoint M on the pressure bar 41, and the vanes 21 are positioned so as to direct the air flow in a direction substantially normal to the front grill. If the switch is now turned off at this point and the louvers are manually adjusted for air flow to the far right as shown in FIG. 3, then the gang bar pin 28 will slide to one side of the point M as shown, with the vanes being held in that fixed position by the friction between the pin 28 and the reciprocating link 37 and the pressure bar 41 on either side thereof.

Considering now that the motor 32 may be non-directional, i.e., when it operates it may run in either a clockwise or a counterclockwise direction, let us consider what occurs when the air sweep motor 32 is again turned on. If the motor 32 runs in a counterclockwise direction, it will drive the reciprocating link 37 and the pressure bar 41 to the left a distance dictated by length of the cam 34. Since the gang bar 24 will be up against the stop 29, the vanes 21 will not move and neither will the pin 28. Thus, when the reciprocating link 37 and the pressure bar 41 have traveled their maximum distance to the left, the point M will again be aligned with the pin 28, and as the link 37 and bar 41 start back to the right, the mechanism will again be in the normal air sweep configuration with the pin 28 remaining aligned with the point M.

Figure 4:
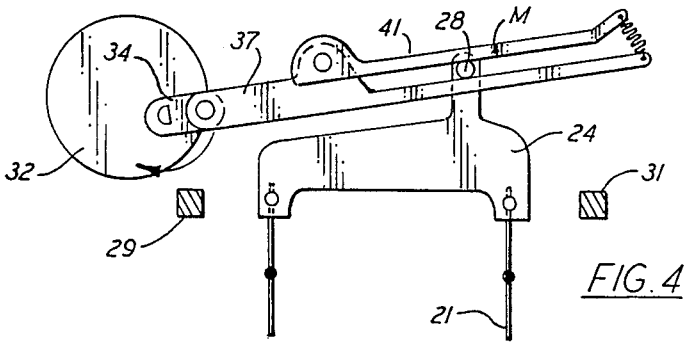
FIGS. 4 and 5 are schematic illustrations thereof with the linkage in intermediate positions during realignment.
Figure 5:
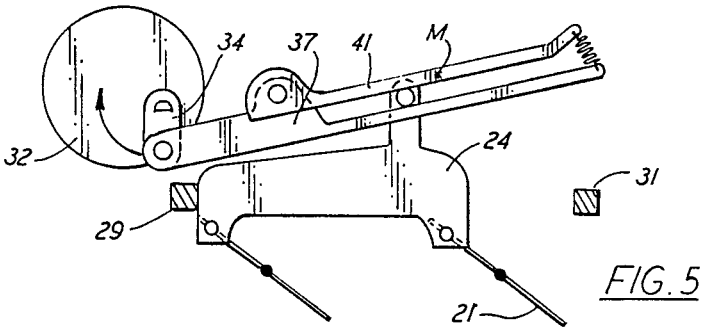

If the motor 32 starts up in a clockwise direction, the pin 28 will remain in its removed position with respect to point M, and the vanes 21 will be driven away from the stop 29 as shown in FIG. 4. As the motor now continues to rotate the cam member 34, the reciprocating link 37 and the pressure bar 41 are again moved to the left until the gang bar hits the stop 29 as shown in FIG. 5. But the reciprocating link 37 and the pressure bar 41 will continue to move to the left until the midpoint M is aligned with the pin 28, after which the normal air sweep operation will continue.

It will thus be seen that the stop 29 operates to recalibrate the position of the gang bar 24 with respect to the reciprocating link 37 after the pin 28 has been adjusted away from the mid-point M for one of the two reasons mentioned hereinabove. It should be recognized that the stop 31 will operate in the same manner when the vanes have been moved to the far left position for one of those reasons.

While the present invention has been disclosed with particular reference to a preferred embodiment, the concepts of this invention are readily adaptable to other embodiments, and those skilled in the art may vary the structure thereof without departing from the essential spirit of the present invention. For example, while the invention has been described in terms of use with vanes disposed on vertical axes, it would be just as applicable with regard to use with vanes mounted on horizontal axes. Other variations will also occur to those skilled in the art. It is contemplated that such variations are within the scope of the appended claims.

What is claimed is:

1. In a room air conditioner of the type having an air discharge opening and an air sweep mechanism located near the opening and including a reciprocating gang bar for pivoting a plurality of vanes between selected limits to thereby vary the direction of flow of discharge air, comprising:

drive means for providing the motive power for moving the gang bar in a reciprocating manner;

linkage means for mechanically connecting said drive means to said gang bar, said linkage means and said gang bar having an established positional relationship;

slippage means associated with said linkage means for allowing movement between said linkage means and said gang bar so as to allow selective and occasional deviation in said established positonal relationship; and stationary stop means for engagement with the gang bar to temporarily stop the reciprocal movement thereof while allowing continued movement of said linkage means so as to reestablish said established positional relationship subsequent to said deviation therefrom.

2. An air sweep mechanism as set forth in claim 1 when said slippage means includes a pair of elongate members interconnected in a substantially parallel arrangement to frictionally engage a third member therebetween.

3. An air sweep mechanism as set forth in claim 2 and including biasing means for biasing said pair of elongate members together.

4. An air sweep mechanism as set forth in claim 2 wherein said third member is generally cylindrical in cross section and is attached to said gang bar.

5. An air sweep mechanism as set forth in claim 1 wherein said linkage means comprises: a cam member drivingly attached at its one end to the drive means;

a reciprocating member attached at its one end to the other end of said cam member; and a driven member which is frictionally engaged with said reciprocating member.

6. An air sweep mechanism as set forth in claim 5 wherein said reciprocating member comprises a pair of elongate members interconnected in a substantially parallel arrangement with their one ends being biased together.

7. An air sweep mechanism as set forth in claim 5 wherein said friction member is integrally attached to said gang bar.

8. An improved air sweep mechanism of the type having a plurality of vanes that are pivotable about their axes and are attached to a common gang bar which is oscillated by a drive means to cause the vanes to sweep from side to side, wherein the improvement comprises:

a driving link and a driven link interconnected between the gang bar and the drive means, said driving link comprising a pair of substantially parallel arms frictionally engaged to said driven link disposed therebetween and which in turn is mechanically connected to the gang bar, said frictional engagement being such as to permit no relative movement between said driving and driven links during normal air sweep operation but to allow such relative movement therebetween when either the drive means or the vanes are held to a fixed position.

9. The air sweep mechanism as set forth in claim 8 and including biasing means for biasing said driving link arms together.

10. An air sweep mechanism as set forth in claim 8 and including a cam member interconnected between said driving link and said drive means for causing said driving link to be driven in a reciprocal manner.

11. An air sweep mechanism as set forth in claim 8 wherein said driving and driven links have an established positional relationship during normal sweep operation, and including a stationary stop means for engagement with said gang bar to temporarily stop movement of said gang bar and said driven link to reestablish said established positional relationship after relative movement between said driving and driven links has been permitted.

* * * * *